US011008833B2

(12) United States Patent
Larchar et al.

(10) Patent No.: US 11,008,833 B2
(45) Date of Patent: May 18, 2021

(54) DRILLING FLUID DISPOSAL INJECTION SYSTEM AND METHOD

(71) Applicant: Milestone Environmental Services, LLC., Houston, TX (US)

(72) Inventors: Jason Larchar, Spring, TX (US); Steve Bills, Houston, TX (US)

(73) Assignee: MILESTONE ENVIRONMENTAL SERVICES, LLC, Houston, TX (US)

( * ) Notice: Subject to any disclaimer, the term of this patent is extended or adjusted under 35 U.S.C. 154(b) by 140 days.

(21) Appl. No.: 16/387,207

(22) Filed: Apr. 17, 2019

(65) Prior Publication Data

US 2020/0332626 A1 Oct. 22, 2020

(51) Int. Cl.

| | |
|---|---|
| ***E21B 43/40*** | (2006.01) |
| ***E21B 41/00*** | (2006.01) |
| ***E21B 21/06*** | (2006.01) |
| ***E21B 21/01*** | (2006.01) |
| ***E21B 21/08*** | (2006.01) |

(52) U.S. Cl.

CPC ..... *E21B 41/0057* (2013.01); *E21B 21/01* (2013.01); *E21B 21/062* (2013.01); *E21B 21/065* (2013.01); *E21B 21/08* (2013.01)

(58) Field of Classification Search

CPC ..... E21B 21/066; E21B 21/065; E21B 43/40; E21B 43/34; E21B 43/35

See application file for complete search history.

(56) References Cited

U.S. PATENT DOCUMENTS

| | | | | |
|---|---|---|---|---|
| 2,365,858 | A * | 12/1944 | Binkley | E21B 21/01 175/57 |
| 4,216,836 | A * | 8/1980 | Rayborn | |
| 4,250,974 | A * | 2/1981 | Heilhecker | |
| 5,310,285 | A * | 5/1994 | Northcott | |
| 5,570,749 | A * | 11/1996 | Reed | |
| 9,518,435 | B2 * | 12/2016 | Fout | C09K 8/24 |
| 2006/0124524 | A1 * | 6/2006 | Duhe | C02F 1/34 210/188 |
| 2008/0237141 | A1 * | 10/2008 | Kerfoot | C09K 8/665 210/739 |
| 2010/0186767 | A1 * | 7/2010 | Martin | B09B 3/00 134/1 |
| 2011/0303622 | A1 * | 12/2011 | Saik | B09C 1/02 210/806 |
| 2014/0209312 | A1 * | 7/2014 | Munisteri | B01D 21/34 166/308.1 |
| 2014/0371113 | A1 * | 12/2014 | Fout | E21B 21/066 507/117 |
| 2018/0016875 | A1 * | 1/2018 | Shokanov | E21B 21/01 |

* cited by examiner

*Primary Examiner* — Kipp C Wallace
(74) *Attorney, Agent, or Firm* — MH2 Technology Law Group LLP

(57) ABSTRACT

A system for injecting a portion of a drilling fluid waste into a well includes a receiving pit configured to receive a drilling fluid waste. A shaker is configured to receive the drilling fluid waste from the receiving pit and to separate solids from the drilling fluid waste to produce a separated drilling fluid waste. A mixing tank is configured to receive the separated drilling fluid waste from the shaker and to mix the separated drilling fluid waste. One or more tanks are configured to receive water. A pump is configured to cause the separated drilling fluid waste and the water to flow into a well.

22 Claims, 2 Drawing Sheets

DRILLING FLUID DISPOSAL INJECTION SYSTEM AND METHOD

BACKGROUND

When drilling a wellbore in a subterranean formation, a fluid is pumped down into the wellbore to cool the drill bit and to circulate cuttings from the subterranean formation back to the surface. This fluid with cuttings is referred to as a drilling fluid waste. The drilling fluid waste may present environmental liabilities and may be expensive to dispose of at the surface. As a result, it may be desirable to dispose of the drilling fluid waste by pumping at least a portion of the drilling fluid waste back into the subterranean formation. However, particles in the drilling fluid waste may fall out of the drilling fluid waste if the density and/or viscosity of the drilling fluid waste is not within a predetermined range. This may limit the amount of drilling waste fluid that may be pumped back into the subterranean formation.

SUMMARY

A system for injecting a portion of a drilling fluid waste into a well is disclosed. The system includes a receiving pit configured to receive a drilling fluid waste. A shaker is configured to receive the drilling fluid waste from the receiving pit and to separate solids from the drilling fluid waste to produce a separated drilling fluid waste. A mixing tank is configured to receive the separated drilling fluid waste from the shaker and to mix the separated drilling fluid waste. One or more tanks are configured to receive water. A pump is configured to cause the separated drilling fluid waste and the water to flow into a well.

In another embodiment, the system includes a trench configured to receive a drilling fluid waste from a vehicle or a pipeline. A receiving pit is configured to receive the drilling fluid waste from the trench. The receiving pit includes one or more weirs. At least a portion of the drilling fluid waste is transferred from the receiving pit back to the trench. A shaker is configured to separate solids from the drilling fluid waste to produce a separated drilling fluid waste. A drying slab is configured to receive the solids from the receiving pit and the shaker. A mixing tank is configured to receive the separated drilling fluid waste from the shaker and to mix the separated drilling fluid waste. At least a portion of the separated drilling fluid waste is transferred into the receiving pit. A first tank is configured to receive water and to separate solids from the water to produce a first separated water. A second tank is configured to receive the first separated water and to separate oil from the first separated water to produce a second separated water. A third tank is configured to receive the oil from the second tank. A fourth tank is configured to receive the second separated water from the second tank. At least a portion of the second separated water is transferred from the fourth tank to the trench. A pump is configured to cause the separated drilling fluid waste and the second separated water to flow into a well.

A method for injecting a portion of a drilling fluid waste into a well is also disclosed. The method includes transferring a drilling fluid waste from a trench into a receiving pit. The method also includes transferring the drilling fluid waste from the receiving pit to a shaker. The method also includes separating solids from the drilling fluid waste, using the shaker, to produce a separated drilling fluid waste. The method also includes transferring the separated drilling fluid waste from the shaker into a mixing tank. The method also includes introducing the separated drilling fluid waste from the mixing tank into a well. The method also includes introducing water from one or more tanks into the well.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
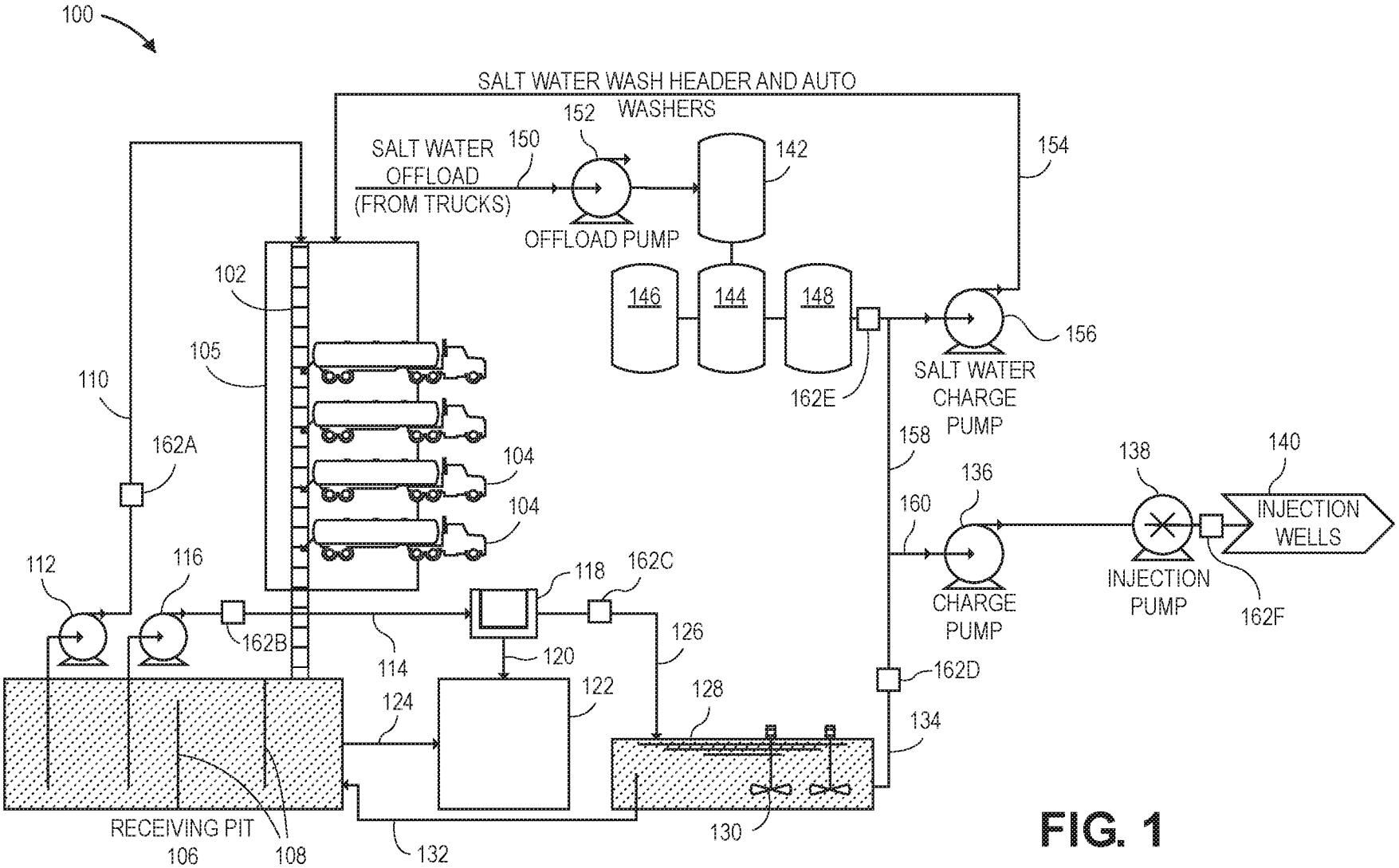
FIG. 1 illustrates a schematic view of a fluid disposal injection system, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. The embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Finally, unless otherwise provided herein, "or" statements are intended to be non-exclusive; for example, the statement "A or B" should be considered to mean "A, B, or both A and B."

FIG. 1 illustrates a schematic view of a fluid disposal injection system 100, according to an embodiment. The system 100 may be used to treat and subsequently inject a drilling fluid waste into a disposal well in a subterranean formation. The system 100 may include a trench 102 configured to receive a drilling fluid waste from a wellbore. The drilling fluid waste may include cuttings (e.g., clay), water, hydrocarbons, chemicals introduced into the wellbore, or a combination thereof. The trench 102 may include a grate or other screening device that may be configured to allow one or more vehicles (e.g., trucks) 104 to drive over the trench 102, enabling a pull-through arrangement in the receiving area 105, rather than a back-in. Thus, as shown, the drilling fluid waste may be transported from the wellbore to the trench 102 via the one or more trucks 104. In another embodiment, the drilling fluid waste may be transported from the wellbore to the trench 102 via a pipeline.

The system 100 may also include a receiving pit 106 that may receive the drilling fluid waste from the trench 102. The receiving pit 106 may include one or more weirs 108 that form a tortuous path through the receiving pit 106, which may serve to mix the drilling fluid waste into a substantially homogeneous state. A portion of the drilling fluid waste in the receiving pit 106 may be transferred (e.g., through line 110 via pump 112) back to the trench 102 where the drilling fluid waste may be used to create a slurry in the trench 102 to help the solids flow into the receiving pit 106 rather than accumulate in the trench 102. Another portion of the drilling fluid waste in the receiving pit 106 may be transferred (e.g., through line 114 via pump 116) to a shaker 118.

The shaker 118 may be or include a shale shaker, a centrifuge, a filter, a strainer basket, a sieve, or the like. The shaker 118 may filter/separate solids (e.g., particles) from the drilling fluid waste, thereby producing a removed set of solids (e.g., particles) and a separated drilling fluid waste. In some embodiments, the shaker 118 may be provided by or otherwise representative of several shakers 118 operating in parallel. The solids separated by the shaker 118 may have a maximum cross-sectional dimension that is greater than about 100 microns, greater than about 200 microns, greater than about 300 microns, greater than about 400 microns, greater than about 500 microns, or larger. The size of the solids to be removed may be determined by formation properties, anticipated pumping schedules, and/or injection modeling software. For example, formations of higher porosity (e.g., >20%) can tolerate solids particles upwards of 1,000 microns, while formations of lower porosity (e.g., <10%) can tolerate fine particles less than 100 microns. In one example, the size of the solids may be determined by analyzing the formation porosity from gamma-ray emitting tools from open-hole logs and coordinating the porosity of a disposal well with an appropriate classification size.

The removed set of solids output from the shaker 118 may be transferred (e.g., through line 120) to a drying slab 122. The solids may then be ground into smaller particles sizes and introduced into the receiving pit 106, the shaker 118, and/or the mixing tank 128. In another embodiment, the solids may be introduced into a centrifuge (e.g., the shaker 118) for dewatering. In yet another embodiment, the solids may be transported to a landfill.

In at least one embodiment, at least a portion of the solids in the drilling fluid waste in the receiving pit 106 may bypass the shaker 118 and be transferred (e.g., through line 124) to the drying slab 122. More particularly, the solids that settle on the bottom of the receiving pit 106 may bypass the shaker 118 and be transferred to the drying slab 122.

The separated drilling fluid waste from the shaker 118 may be transferred (e.g., through line 126) to a mixing tank 128. The mixing tank 128 may also be referred to as a shaker tank. The mixing tank 128 may include one or more mixers 130 that stir/mix the separated drilling fluid waste from the shaker 118 into a substantially homogeneous state. In at least one embodiment, one or more chemical additives may be added to the separated drilling fluid waste in the mixing tank 128. Although a single mixing tank 128 is shown, in other embodiment, a plurality of mixing tanks may be utilized. One or more of the additional mixing tanks may not have associated shakers (e.g., such as shaker 118).

In at least one embodiment, at least a portion of the separated drilling fluid waste may be transferred (e.g., via line 132) back into the receiving pit 106 to provide overflow protection (e.g., to prevent the mixing tank 128 from overflowing) and/or provide recirculation to clean the receiving pit 106. At least a portion of the separated drilling fluid waste may be transferred (e.g., through line 134 via one or more pumps 136, 138) into a well 140. The pump 136 may be or include a charge pump, and the pump 138 may be or include an injection pump. The well 140 may be or include a disposal well (also referred to as an injection well).

The system 100 may also include a plurality of tanks (four are shown: 142, 144, 146, 148). Water may be introduced into the first tank 142 (e.g., through line 150 via an offload pump 152). The water may be introduced from one or more of the trucks 104. The water may be fresh water, salt water, brackish water, brine, or the like. The first tank 142 may be or include a de-sanding or buffer tank that is configured to separate solids (e.g., particles) such as sand from the water to produce a first separated water. The first separated water may be transferred into the second tank 144.

The second tank 144 may be or include a skim tank (also referred to as a gunbarrel tank) that is configured to separate oil from the first separated water to produce a second separated water. The oil may be transferred from the second tank 144 to the third tank 146, and the second separated water may be transferred from the second tank 144 to the fourth tank 148.

At least a portion of the second separated water may be transferred (e.g., through line 154 via pump 156) back to the trench 102 and/or the trucks 104. For example, the second separated water may be sprayed onto the trench 102 and/or in the trucks 104 (e.g., by one or more sprinklers, automated tank cleaners, or hoses and valves) to clean or otherwise remove buildup of the drilling fluid waste and solids. At least a portion of the second separated water may be transferred (e.g., through lines 158, 160 via pumps 136, 138) to the well 140.

The system 100 may also include one or more sensors (six are shown: 162A-F). The first sensor 162A may be configured to measure one or more properties of the drilling fluid waste flowing form the receiving pit 106 to the trench 102 in line 110. The second sensor 162B may be configured to measure one or more properties of the drilling fluid waste flowing from the receiving pit 106 to the shaker 118 in line 114. The third sensor 162C may be configured to measure one or more properties of the separated drilling fluid waste flowing from the shaker 118 to the mixing tank 128 in line 126. The fourth sensor 162D may be configured to measure one or more properties of the separated drilling fluid waste flowing from the mixing tank 128 to the well 140 in line 134. The fifth sensor 162E may be configured to measure one or more properties of the second separated water flowing from the fourth tank 148 to the well 140 in line 158. The sixth sensor 162F may be configured to measure one or more properties of the separated drilling fluid waste, the second separated water, or a combination/mixture thereof flowing to the well 140 in line 160. The properties may be or include flowrate, viscosity, density, pH level, percentage of solids, size of solids, pressure, temperature, or a combination thereof. A flowrate of the separated drilling fluid waste in line 134 and/or the second separated water in line 158 may be modified to obtain the desired ratio of the mixture for injection into the well 140. The ratio of the separated drilling fluid waste to the second separated water may be from about 10:1 to about 5:1, about 5:1 to about 3:1, about 3:1 to about 1:1, about 1:1 to about 1:3, about 1:3 to about 1:5, or about 1:5 to about 1:10. In another embodiment, the separated drilling fluid waste may be pumped into the well 140 before and/or after the second separated water, such that the separated drilling fluid waste and the second separated water are not combined/mixed prior to being pumped in to the well 140.

Figure 2:
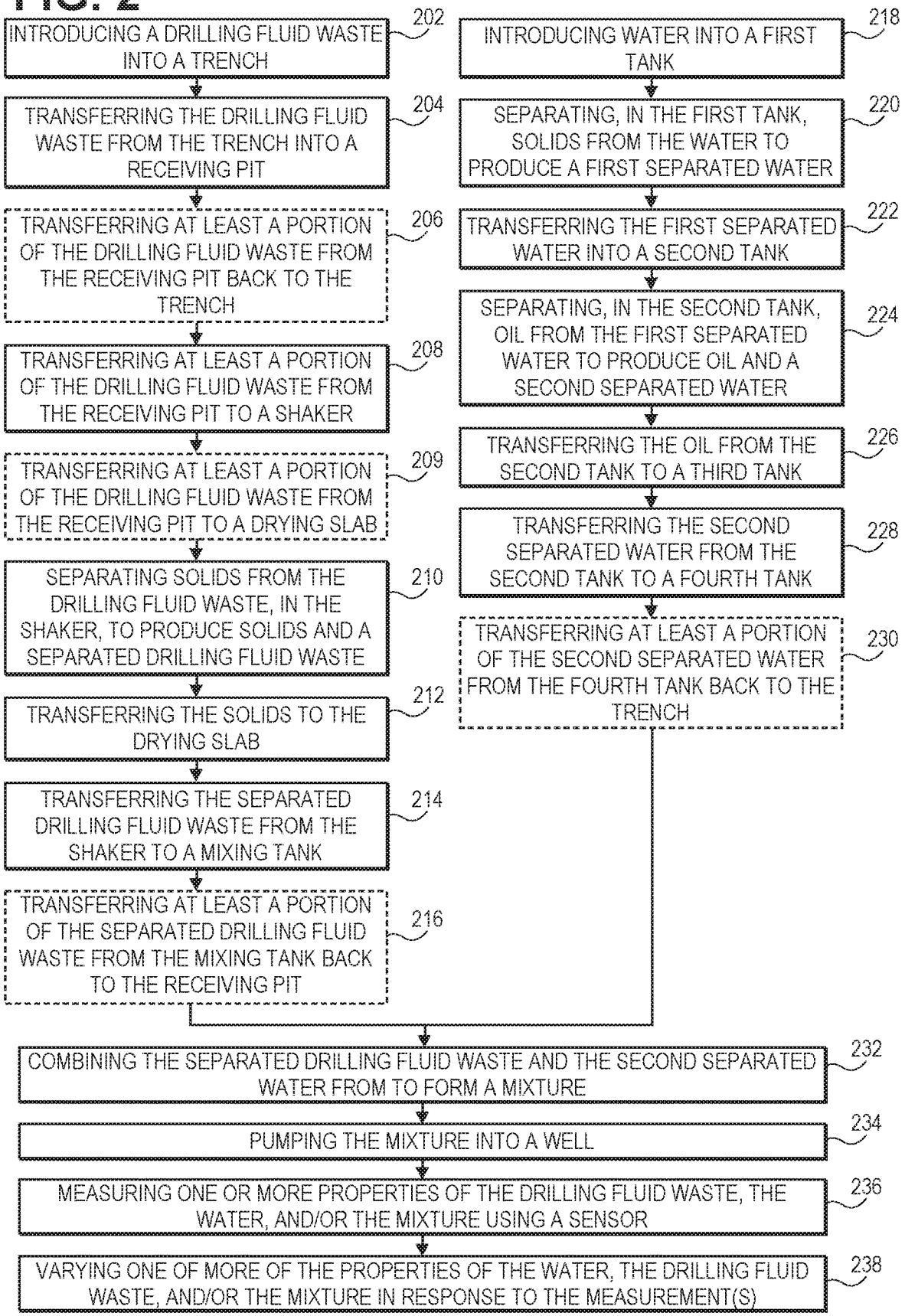
FIG. 2 illustrates a flowchart of a method for injecting a portion of a drilling fluid waste into a well, according to an embodiment.

FIG. 2 illustrates a flowchart of a method 200 for injecting a portion of a drilling fluid waste into the well 140, according to an embodiment. The method 200 may include introducing the drilling fluid waste into the trench, as at 202. The method 200 may also include transferring the drilling fluid waste from the trench into the receiving pit 106, as at 204. The method 200 may also optionally include transferring at least a portion of the drilling fluid waste from the receiving pit 106 back to the trench, as at 206. The method 200 may also or instead include transferring at least a portion of the drilling fluid waste from the receiving pit 106 to the shaker 118, as at 208. The method 200 may also or instead optionally include transferring at least a portion of the solids in the drilling fluid waste in the receiving pit 106 to the drying slab 122, as at 209.

The method 200 may also include separating solids from the drilling fluid waste (e.g., using the shaker 118) to produce solids and a separated drilling fluid waste, as at 210. The method 200 may also include transferring the solids to the drying slab 122, as at 212. The method 200 may also include transferring the separated drilling fluid waste from the shaker 118 to the mixing tank 128, as at 214. The method 200 may also optionally include transferring at least a portion of the separated drilling fluid waste from the mixing tank 128 back to the receiving pit 106, as at 216.

The method 200 may also include introducing water into the first tank 142, as at 218. The method 200 may also include separating, in the first tank 142, solids from the water to produce a first separated water, as at 220. The method 200 may also include transferring the first separated water into the second tank 144, as at 222. The method 200 may also include separating, in the second tank 144, oil from the first separated water to produce oil and a second separated water, as at 224. The method 200 may also include transferring the oil from the second tank 144 to the third tank 146, as at 226. The method 200 may also include transferring the second separated water from the second tank 144 to the fourth tank 148, as at 228.

The method 200 may also optionally include transferring at least a portion of the second separated water from the fourth tank 148 back to the trench 102 and/or the trucks 104, as at 230. As mentioned above, the second separated water may be used to clean/wash the trench 102 and/or the trucks 104. The method 200 may also include combining and/or mixing the separated drilling fluid waste from the mixing tank 128 (in line 134) and the second separated water from the fourth tank 148 (in line 158) to form a mixture in line 160, as at 232. The method 200 may also include pumping the mixture in line 160 into the well 140 (e.g., using the pump(s) 136, 138), as at 234. One or more of the pumps 136, 138 may facilitate the mixing.

In another embodiment, the separated drilling fluid waste and the second separated water may not be combined/mixed prior to being pumped in to the well 140. Rather, they may be pumped separately into the well 140. For example, the separated drilling fluid waste may be pumped into the well 140 before the second separated water. In another example, the second separated water may be pumped into the well 140 before the separated drilling fluid waste. In yet another example, the order in which the separated drilling fluid waste and the second separated water are pumped into the well 140 may alternate (e.g., separated drilling fluid waste, second separated water, separated drilling fluid waste, second separated water, etc.).

The method 200 may also include measuring one or more properties of the drilling fluid waste, the water, and/or the mixture using the sensors 162A-F, as at 236. The method 200 may also include varying one of more of the properties of the water, the drilling fluid waste, and/or the mixture in response to the measurement(s), as at 238. In one example, the sensor 162D may measure a flow rate of the separated drilling fluid waste, and the sensor 162E may measure a flow rate of the second separated water. In response to these measurements, one or both flow rates may be varied to cause a ratio of the mixture to be within a predetermined range. The predetermined range may depend at least partially upon the drilling fluid waste received, the formation, and the conditions in and/or around the well 140. The flow rate(s) may be varied using one or more valves, pumps, or both.

In one example, the sensor 162D may obtain a measurement of the density and/or viscosity of the separated drilling fluid waste. In another example, the sensor 162F may obtain a measurement of the density and/or viscosity of separated drilling fluid waste, the second separated water, or a combination/mixture thereof. In either of the foregoing examples, if the measurement is outside of a predetermined range, one or more additives may be added to change the measured property. The additives may be or include viscosifiers, barite, polymer, water, or a combination thereof. Alternatively, the amount/flow rate of the separated drilling fluid waste and/or the second separated water may be varied to change the measured property. In another embodiment, no blending, additives, or modifications are made to the separated drilling fluid waste.

The properties of the separated drilling fluid waste, the second separated water, and/or the combination/mixture may depend at least partially on the subterranean formation surrounding the well 140. For example, to carry particles deep within the formation, the viscosity may be sufficient to prevent premature settling. In the system 100, the viscosity may be increased with barite or polymer additives using a series of viscometers and one or more polymer feed pumps with variable frequency drives.

To assist in achieving proper bottom-hole pressure (i.e., the primary force that induces flowrate through, and fracturing of, the subterranean formation), the density of the slurry may be maintained or modified to be sufficient to increase the hydrostatic pressure inside of the fluid column of the well 140. In the system 100, the density may be controlled by adding barite automatically with a barite feed auger in response to measurements from one or more of the sensors 162A-F (e.g., densitometers). In another embodiment, the separated drilling fluid waste, the second separated water, and/or the combination/mixture thereof may be manually weighed, and sacks of barite may be introduced in response to the weight.

The injection rate of the separated drilling fluid waste, the second separated water, and/or the combination/mixture into the well 140 may be set so as to provide a predetermined surface pressure and may, in some implementations, propagate fracture growth in the subterranean formation of the well 140. The injection rate may be controlled with the injection pump 138 automatically through the sensor 162F, which may include a pressure sensor, a flow meter, a densitometer, or a combination thereof. In another embodiment, the injection rate may be controlled manually by adjusting a variable frequency drive of the injection pump 138.

In another embodiment, the pump rate and/or the properties of the separated drilling fluid waste, the second separated water, and/or the combination/mixture may be adjusted based at least partially upon the response of the subterranean formation, the pressure in the well 140, or both. When the injection process is nearing completion, the well 140 may be flushed with water to clean the well 140 and push the particles into the formation. For example, when the injection of the separated drilling fluid waste is nearing completion, the second separated water may then be pumped into the well 140 to clean the well 140 and push the particles from the separated drilling fluid waste into the formation.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A system for injecting a portion of a drilling fluid waste into a well, comprising:

a trench configured to receive a drilling fluid waste from a pipeline or a truck;

a receiving pit configured to receive the drilling fluid waste from the trench;

a shaker configured to receive the drilling fluid waste from the receiving pit and to separate solids from the drilling fluid waste to produce a separated drilling fluid waste;

a mixing tank configured to receive the separated drilling fluid waste from the shaker and to mix the separated drilling fluid waste;

one or more tanks configured to receive and filter water to produce filtered water; and a pump configured to cause the separated drilling fluid waste and a first portion of the filtered water to flow into a well, wherein a second portion of the filtered water is transferred to the trench, the pipeline, the truck, or a combination thereof.

2. The system of claim 1, further comprising a line that is in fluid communication with the pump, wherein the pump causes the separated drilling fluid waste to flow through the line and into the well and then subsequently causes the first portion of the water to flow through the line and into the well.

3. The system of claim 1, further comprising a line that is in fluid communication with the pump, wherein the separated drilling fluid waste and the first portion of the water are combined to form a mixture in the line at a point that is upstream from the pump, and wherein the mixture flows through the pump and into the well.

4. The system of claim 1, wherein at least a portion of the drilling fluid waste is transferred from the receiving pit back to the trench, and wherein the drilling fluid waste is disposed within the trench and the receiving pit prior to being transferred into the shaker.

5. The system of claim 1, wherein at least a portion of the separated drilling fluid waste is transferred from the mixing tank back into the receiving pit.

6. The system of claim 1, further comprising a drying slab configured to receive the solids from the shaker, the receiving pit, or both.

7. The system of claim 1, wherein the one or more tanks comprises:

a first tank configured to receive the water and to separate solids from the water to produce a separated water;

a second tank configured to receive the separated water and to separate oil from the first separated water to produce the filtered water;

a third tank configured to receive the oil from the second tank; and a fourth tank configured to receive the filtered water from the second tank water.

8. The system of claim 7, wherein the second portion of the filtered water is transferred from the fourth tank to the trench.

9. The system of claim 1, further comprising:

a first sensor configured to measure a first property of the separated drilling fluid waste flowing from the mixing tank to the well; and a second sensor configured to measure a second property of the water flowing from the one or more tanks to the well, wherein the first property, the second property, or both comprises flowrate, density, viscosity, or a combination thereof.

10. The system of claim 9, further comprising a third sensor configured to measure a third property of a mixture of the separated drilling fluid waste and the water, wherein the third property comprises flowrate, density, viscosity, or a combination thereof.

11. The system of claim 1, wherein the second portion of the filtered water is transferred to the trench.

12. The system of claim 1, wherein the second portion of the filtered water is used to prevent or remove buildup of the drilling fluid waste in the trench, the pipeline, the truck, or a combination thereof.

13. A system for injecting a portion of a drilling fluid waste into a well, comprising:

a trench configured to receive a drilling fluid waste from a vehicle or a pipeline;

a receiving pit configured to receive the drilling fluid waste from the trench, wherein the receiving pit comprises one or more weirs, and wherein at least a portion of the drilling fluid waste is transferred from the receiving pit back to the trench;

a shaker configured to separate solids from the drilling fluid waste to produce a separated drilling fluid waste;

a drying slab configured to receive the solids from the receiving pit and the shaker;

a mixing tank configured to receive the separated drilling fluid waste from the shaker and to mix the separated drilling fluid waste, wherein at least a portion of the separated drilling fluid waste is transferred into the receiving pit;

a first tank configured to receive water and to separate solids from the water to produce a first separated water;

a second tank configured to receive the first separated water and to separate oil from the first separated water to produce a second separated water;

a third tank configured to receive the oil from the second tank;

a fourth tank configured to receive the second separated water from the second tank, wherein at least a portion of the second separated water is transferred from the fourth tank to the trench; and a pump configured to cause the separated drilling fluid waste and the second separated water to flow into a well.

14. A method for injecting a portion of a drilling fluid waste into a well, comprising:

transferring a drilling fluid waste from a pipeline or truck into a trench;

transferring the drilling fluid waste from the trench into a receiving pit;

transferring a first portion of the drilling fluid waste from the receiving pit back into the trench;

transferring a second portion of the drilling fluid waste from the receiving pit to a shaker, wherein the second portion of the drilling fluid waste is disposed within the trench and the receiving pit prior to being transferred into the shaker;

separating solids from the second portion of the drilling fluid waste, using the shaker, to produce a separated drilling fluid waste;

transferring the separated drilling fluid waste from the shaker into a mixing tank;

introducing the separated drilling fluid waste from the mixing tank into a well; and introducing water from one or more tanks into the well.

15. The method of claim 14, further comprising transferring at least a portion of the separated drilling fluid waste from the mixing tank to the receiving pit.

16. The method of claim 14, further comprising transferring the solids from the receiving pit and the shaker to a drying slab.

17. The method of claim 14, further comprising:

separating solids from the water in a first of the one or more tanks to produce a first separated water;

transferring the first separated water from the first tank into a second of the one or more tanks;

separating oil from the first separated water in the second tank to produce oil and a second separated water;

transferring the oil from the second tank to a third of the one or more tanks; and transferring the second separated water from the second tank to a fourth of the one or more tanks, wherein the water introduced into the well is the second separated water.

18. The method of claim 17, wherein the water in the first tank comprises salt water.

19. The method of claim 17, further comprising transferring at least a portion of the second separated water from the fourth tank to the trench.

20. The method of claim 14, wherein the separated drilling fluid waste is introduced into the well before the water is introduced into the well.

21. The method of claim 14, further comprising:

measuring a first property of the separated drilling fluid waste flowing from the mixing tank; and measuring a second property of the water flowing from the one or more tanks, wherein the first property, the second property, or both comprises flowrate, density, viscosity, or a combination thereof.

22. A system for injecting a portion of a drilling fluid waste into a well, comprising:

a trench configured to receive a drilling fluid waste from a pipeline or a truck;

a receiving pit configured to receive the drilling fluid waste from the trench, wherein at least a portion of the drilling fluid waste is transferred from the receiving pit back to the trench;

a shaker configured to receive the drilling fluid waste from the receiving pit and to separate solids from the drilling fluid waste to produce a separated drilling fluid waste, wherein the drilling fluid waste passes through the trench and the receiving pit prior to flowing into the shaker;

a mixing tank configured to receive the separated drilling fluid waste from the shaker and to mix the separated drilling fluid waste;

one or more tanks configured to receive water; and a pump configured to cause the separated drilling fluid waste and the water to flow into a well.

* * * * *